US006066841A

United States Patent [19]

Kim et al.

[11] Patent Number: 6,066,841

[45] Date of Patent: May 23, 2000

[54] MICROWAVE OVEN

[75] Inventors: Tae-Bong Kim; Ki-Hun Joo; Jong-Sup Shin; Eung-Sup Lee, all of Suwon, Rep. of Korea

[73] Assignee: Samsung Electronics Co., Ltd., Suwon, Rep. of Korea

[21] Appl. No.: 09/131,170

[22] Filed: Aug. 7, 1998

[30] Foreign Application Priority Data

| | | | |
|---|---|---|---|
| Dec. 2, 1997 | [KR] | Rep. of Korea | 97-65384 |
| Dec. 2, 1997 | [KR] | Rep. of Korea | 97-65385 |
| Jun. 26, 1998 | [KR] | Rep. of Korea | 98-24443 |

[51] Int. Cl.[7] ..... H05B 6/74

[52] U.S. Cl. ..... 219/746; 219/748; 219/756; 219/795

[58] Field of Search ..... 219/746, 748, 219/756, 795

[56] References Cited

U.S. PATENT DOCUMENTS

| | | | |
|---|---|---|---|
| 5,237,139 | 8/1993 | Berg et al. | 219/10.55 A |
| 5,438,183 | 8/1995 | Hayami et al. | 219/748 |
| 5,567,339 | 10/1996 | Joo et al. | 219/748 |
| 5,825,000 | 10/1998 | Jun | 219/746 |
| 5,874,715 | 2/1999 | Choi | 219/746 |

*Primary Examiner*—Teresa Walberg
*Assistant Examiner*—Shawntina Fuqua
*Attorney, Agent, or Firm*—Burns, Doane, Swecker & Mathis, L.L.P.

[57] ABSTRACT

A microwave oven adapted to radiate microwaves of mutually reverse phases to minimize impedance variation of a waveguide in response to load change of foodstuff, thereby maintaining an output of the microwave at a constant level regardless of load amount of the foodstuff and maintaining an electric field distribution in a cavity at a constant level as well.

14 Claims, 11 Drawing Sheets

MICROWAVE OVEN

BACKGROUND OF THE INVENTION

1. Field of the Invention

The present invention relates to a microwave oven, and more particularly to a microwave oven adapted to radiate microwaves of mutually reverse phases to minimize impedance variation of a waveguide in response to load change of foodstuff, thereby maintaining an output of the microwave at a constant level regardless of load amount of the foodstuff and maintaining an electric field distribution in a cavity at a constant level as well.

2. Description of the Prior Art

Generally, a microwave oven is used for radiating microwaves generated by oscillation of a magnetron into a cavity via a waveguide to cook foodstuff lying on a predetermined position in the cavity by way of dielectric heating.

FIG. 1 is a schematic sectional view of a waveguide in a microwave oven according to one embodiment of the present invention, and FIG. 2 is an interpretation drawing of injection struction of the waveguide in FIG. 1, where the waveguide 1 is formed with an insertion inlet 9 through which an antenna 3*a* of a magnetron 3 is inserted and a rectangular radiation hole 7 through which microwave are radiated into a cavity 5.

The microwaves produced by oscillation of the magnetron 3 are radiated into the cavity 5 through the waveguide 1 to cook the foodstuff inside the cavity 5 by way of dielectric heating.

As illustrated in FIG. 2, if a power of the magnetron 3 is given as $P_{in}$ and a power at a predetermined position in the cavity 5 is defined as $P_{out}$, the output $P_{out}$ can be obtained by following formulae 1, 2 and 3.

$$P_{in}=E^2{}_s \quad \text{[Formula 1]}$$

$$E_y=E_s\sin(\chi) \quad \text{[Formula 2]}$$

$$P_{out}=(E_y)^{2\,l}-(E_s\sin(\chi))^2=E_s{}^2\sin(\chi)^2 \quad \text{[Formula 3]}$$

Where, $E_s$ is an electric field energy (by way of example, input electric field energy) formed by microwaves produced by oscillation of the magnetron 3 and $E_y$ is an electric field energy (by way of example, output electric field energy) formed at a predetermined position in the cavity 5. The power of magnetron 3 is a squared value of $E_s$ formed by microwaves generated by oscillation of the magnetron.

Furthermore, the microwaves generated by oscillation of the magnetron 3 are sine waves of certain phase so that the electric field energy $E_y$ at a certain position in the cavity 5 is the electric field energy $E_s$ multiplied by sin(χ), and $P_{out}$ is a squared value of $E_y$.

Accordingly, the power $P_{out}$ varies according to load change. FIG. 3 is a polar chart where impedance characteristic of waveguide 1 according to load change of the foodstuff is illustrated. FIG. 3 is based on a microwave frequency range of 2.44–2.47 GHz, with a load of 2,000 cc water, 500 cc water and 100 cc water, respectively.

As illustrated in FIG. 3, in case of a load of 2,000 cc water, a voltage standing wave Ratio (VSWR) becomes large. In other words, impedance of the waveguide 1 becomes small to increase the power of a microwave oven. In case of a load of 100 cc water, a Voltage Standing Wave Ratio (VSWR) becomes small. In other words, impedance of the waveguide 1 becomes large to thereby decrease the power of the microwave oven.

In other words, there is a problem in that, when a load of foodstuff is large, the power of the microwave oven is a little bit high but when the load is small, impedance of the waveguide is increased to thereby decrease the output of the microwave oven.

Furthermore, there is another problem in that impedance of the waveguide 1 is varied too much by variation of load of foodstuff to thereby make electric field distribution in the cavity 5 inconstant.

There is still another problem in that one waveguide 1 cannot be applied to various kinds of cavities 5, so that each cavity 5 needs separate waveguide 1.

To overcome these problems, Japanese laid-open patent No. Hei 6-111933(disclosed on Apr. 22, 1994) is disclosed, where a two-way guide system of microwave oven, as illustrated in FIG. 4, includes an upper and a lower radiation hole 11*a* and 11*b*, a cavity 12, a magnetron 14 for generating via an antenna 13 microwaves having λg frequency, and a waveguide 15.

At this time, electric waves generated from the magnetron 14 serve to form voltage standing waves, which in turn are radiated into the cavity 12 via the radiation holes 11*a* and 11*b* to evenly heat the foodstuff.

However, there is a problem in the conventional waveguide system of a microwave oven thus constructed, in that only the dispersion efficiency of the microwaves is made better, so that power variation of the microwave oven cannot be overcome adequately according to load changes of foodstuff.

Another prior art of Japanese laid open patent No. Hei 4-233188 (disclosed on Aug. 21, 1992) is disclosed, where a microwave oven for two-way heating method includes, as illustrated in FIG. 5, a waveguide 19, an upper and lower radiation hole 21*a* and 21*b*, a magnetron 23, an antenna 25, and a protruder 27, where the protruder 27 is constructed to have almost the same width as that of the distance of the antenna 25.

At this time, the radiation holes 21*a* and 21*b* are so formed as to have maximum distances and the waveguide 19 is formed at an upper side thereof with a horizontal surface 19*a* and is formed at a bottom side thereof with a slant surface 19*b*.

In the two-way method of a microwave oven thus constructed, microwaves generated from the magnetron 23 are radiated via the antenna into the waveguide 19 and the microwaves radiated into the waveguide 19 form voltage standing waves via the protruder 27 to be directly radiated to the cavity 17 via the upper radiation hole 19*a*. Part of the voltage standing waves are radiated slantedly via the lower radiation hole 19*b* to evenly heat and cook the foodstuff laid on a floor of the cavity 17.

Here, a structure theory of the waveguide 19 for reverse phase radiation can be obtained by the formula 4.

$$A-B=(K+n\cdot 0.5)\lambda g \quad \text{[Formula 4]}$$

Where, A=an overall length of the waveguide 19 measured from an upper periphery of the upper radiation hole 21*a* to a lower periphery of the lower radiation hole 21*b*, B=length of the waveguide 19 measured from a central axis line 29 to an upper periphery of the upper radiation hole 21*a*, K=a constant of value against a 0.7–0.9 range, n=0, 1, 2, 3 . . . and λg=wavelength of a basic mode for a waveguide 19.

The length by the formula 4 is a function of λg, and microwaves of mutually different reverse phases(+, −) serve to evenly heat and cook the foodstuff lying on a floor of the cavity 17.

However, there is a problem in the conventional two-way method of microwave oven thus constructed in that an output waveguide is long and thick to make it difficult to accommodate electronic elements, and impedance of the waveguide 19 is inconsistent according to the cavity 17, so that, whenever the cavity 17 is changed in size thereof, sizes and positions of the upper and lower radiation holes 21*a* and 21*b* are inevitably adjusted and redesigning is unavoidable.

Still furthermore, there is another problem in that microwaves in the cavity 19 are radiated into the cavity with phase differences, electric field distribution mode in the cavity 17 is not wholly formed by the upper and lower radiation hole 21*a* and 21*b* but formed chiefly at the upper and lower.

DETAILED DESCRIPTION OF THE INVENTION

The present invention is disclosed to solve the aforementioned problems and it is an object of the present invention to provide a microwave oven adapted to improve constructions of waveguide and radiation holes to generate reverse phases horizontally, vertically, up and down in the waveguide, thereby forming a multiple electric field distribution modes in a cavity, so that cooking efficiency is improved, impedance by way of load change is minimized and output is maintained constant regardless of load of foodstuff.

In accordance one object of the present invention, there is provided a microwave oven having an input waveguide, and an output waveguide, the microwave oven comprises a magnetron in the output waveguide, the position (A–B) of an antenna of the magnetron being obtained by a formula reading as $A-B=k\cdot\lambda g$, where A=overall length of the output waveguide, B=a distance to the antenna of the magnetron at one side of the output waveguide, $k=0.5\leqq k<0.7$ and $\lambda g$=wavelength in the output waveguide.

In accordance with another object of the present invention, there is provided a microwave oven having an input waveguide and an output waveguide, the output waveguide has a width (a) and a length (b) obtainable by a formula of $a=b=\lambda g$ so that microwaves generated by oscillation of the magnetron can be distributed in wavelength ($\lambda g$) of one cycle in left/right and up/down directions.

In accordance with still another object of the present invention, there is provided a microwave oven having an input waveguide and an output waveguide, the output waveguide including an upper radiation hole and a lower radiation hole, the upper and lower radiation holes comprising:

a vertical slot;

left and right inclined slot, each slot formed in a reverse V-shape so as to be horizontally symmetrical around a central axis line (P) of the vertical slot and in cooperation with the vertical slot at both lower ends thereof, and formed in horizontally slanted at 30°–60°; and horizontal slots, each slot formed at horizontally symmetrical to be cooperative with the left and right inclined slot at a lower external side of the left and right inclined slot.

In accordance with still another object of the present invention, there is provided a microwave oven having an input waveguide and an output waveguide, wherein the output waveguide are respectively formed with a left radiation hole and a right radiation hole, each having a slot width(g) of $g\leqq\lambda g$.

BRIEF DESCRIPTION OF THE DRAWINGS

For fuller understanding of the nature and objects of the invention, reference should be made to the following detailed description taken in conjunction with the accompanying drawings in which:

FIG. 7 is a schematic diagram for illustrating a waveguide installed at a side of a cavity according to the present invention;

FIG. 8 is side sectional view for illustrating a waveguide assembled to a magnetron;

FIGS. 9(I) and 9(II) are front and side views for illustrating an assembled state between an input waveguide and an output waveguide of a waveguide;

FIG. 10 is a detailed view of principal parts for illustrating an upper and a lower radiation hole at an output waveguide;

FIGS. 11(I) and 11(II) are microwave distribution interpretation drawings in a cavity;

FIGS. 13(I) and 13(II) are detailed views of principal elements for illustrating a left and a right radiation hole of the output waveguide in FIG. 12.

DETAILED DESCRIPTION OF THE INVENTION

Now, a first embodiment of the present invention will be described in detail with reference to FIGS. 7 to 11.

Figure 1:
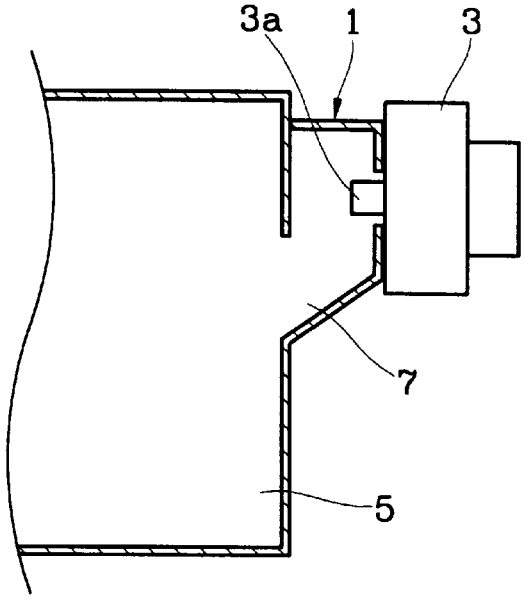
FIG.1 (PRIOR ART)
FIG. 1 is a schematic sectional view for illustrating a waveguide of a microwave oven according to one embodiment of the prior art.
Figure 2:
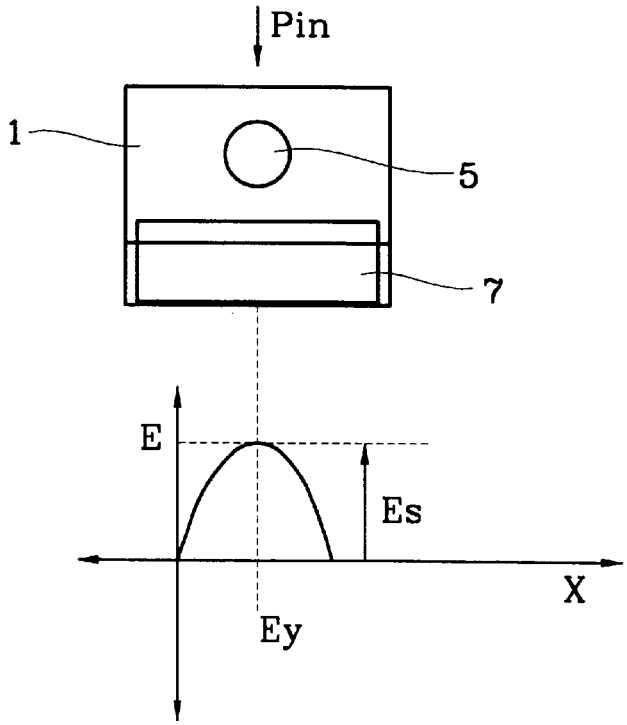
FIG.2 (PRIOR ART)
FIG. 2 is an injection structure interpretation drawing of a waveguide against FIG. 1.
Figure 3:
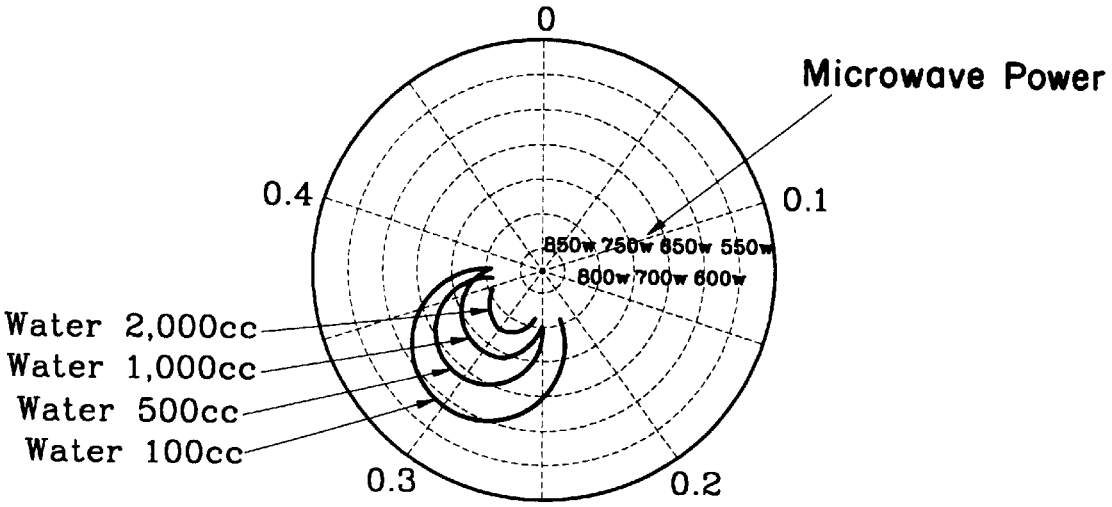
FIG.3 (PRIOR ART)
FIG. 3 is a polarity drawing for illustrating impedance characteristic per load of waveguide against FIG. 1.
Figure 4:
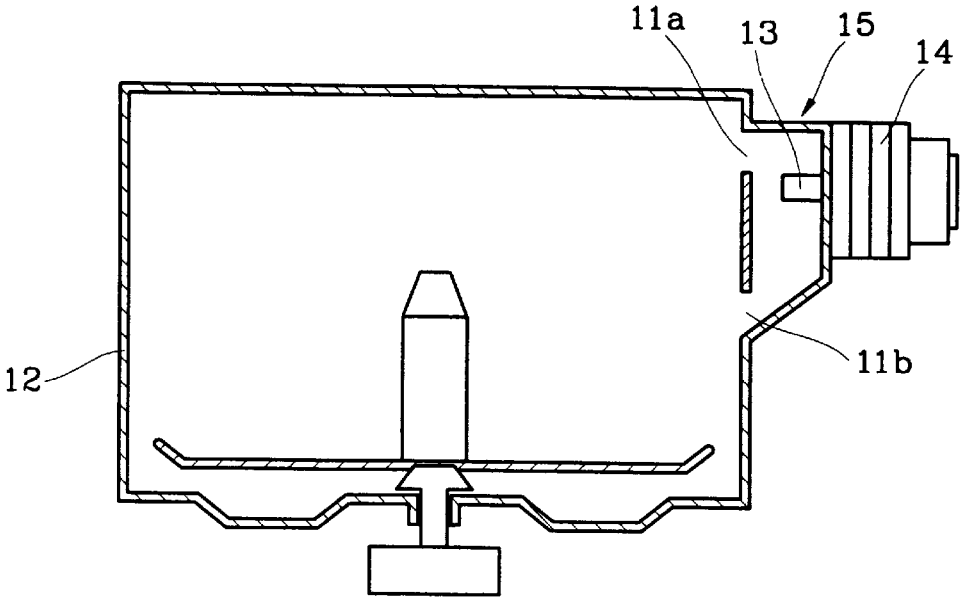
FIG.4 (PRIOR ART)
FIG. 4 is a schematic sectional view for illustrating a waveguide of a microwave oven according to a second embodiment of the prior art.
Figure 5:
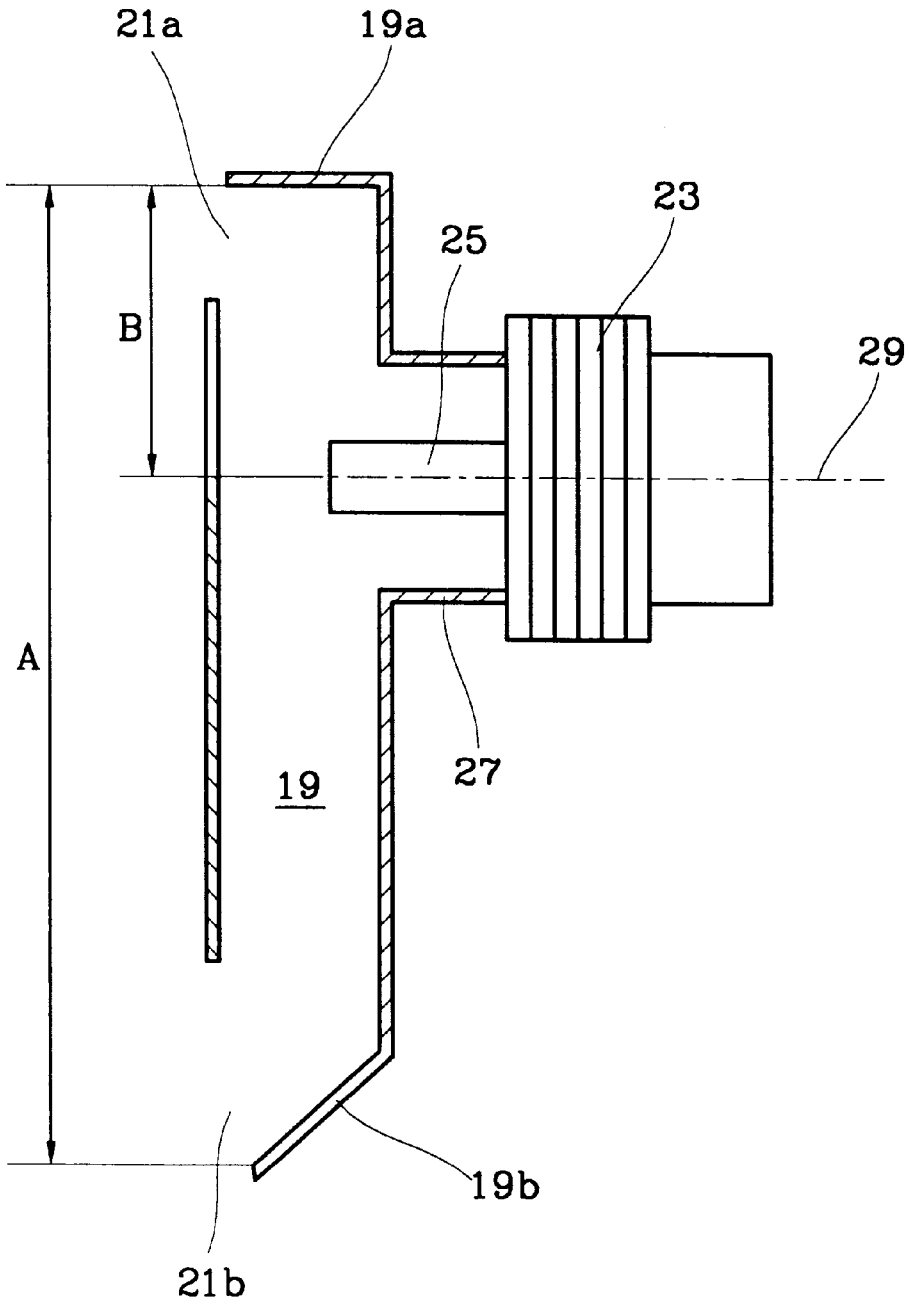
FIG.5 (PRIOR ART)
FIG. 5 is a schematic diagram for illustrating a waveguide of two-way method microwave oven according to a third embodiment of the prior art.
Figure 6:
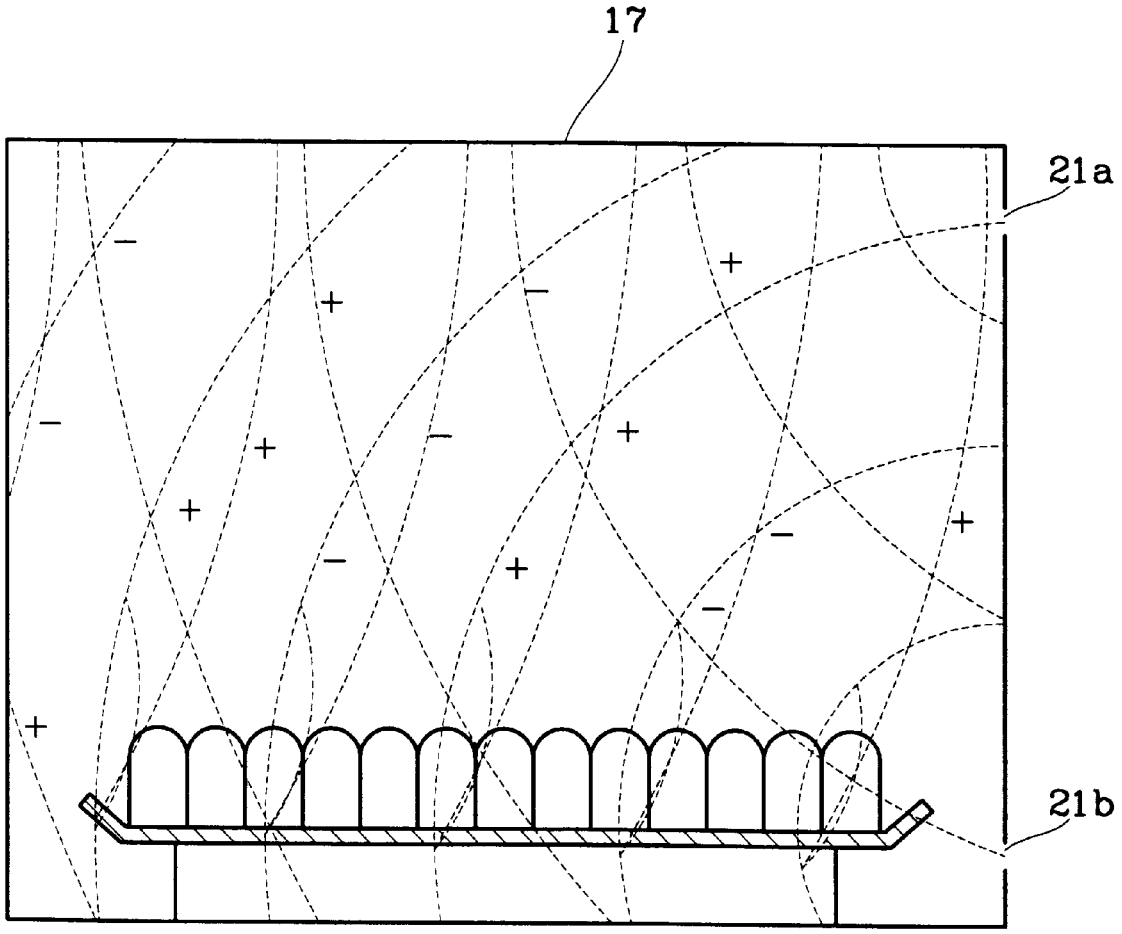
FIG.6 (PRIOR ART)
FIG. 6 is a schematic diagram for illustrating an electric field mode in a cavity in FIG. 5.
Figure 7:
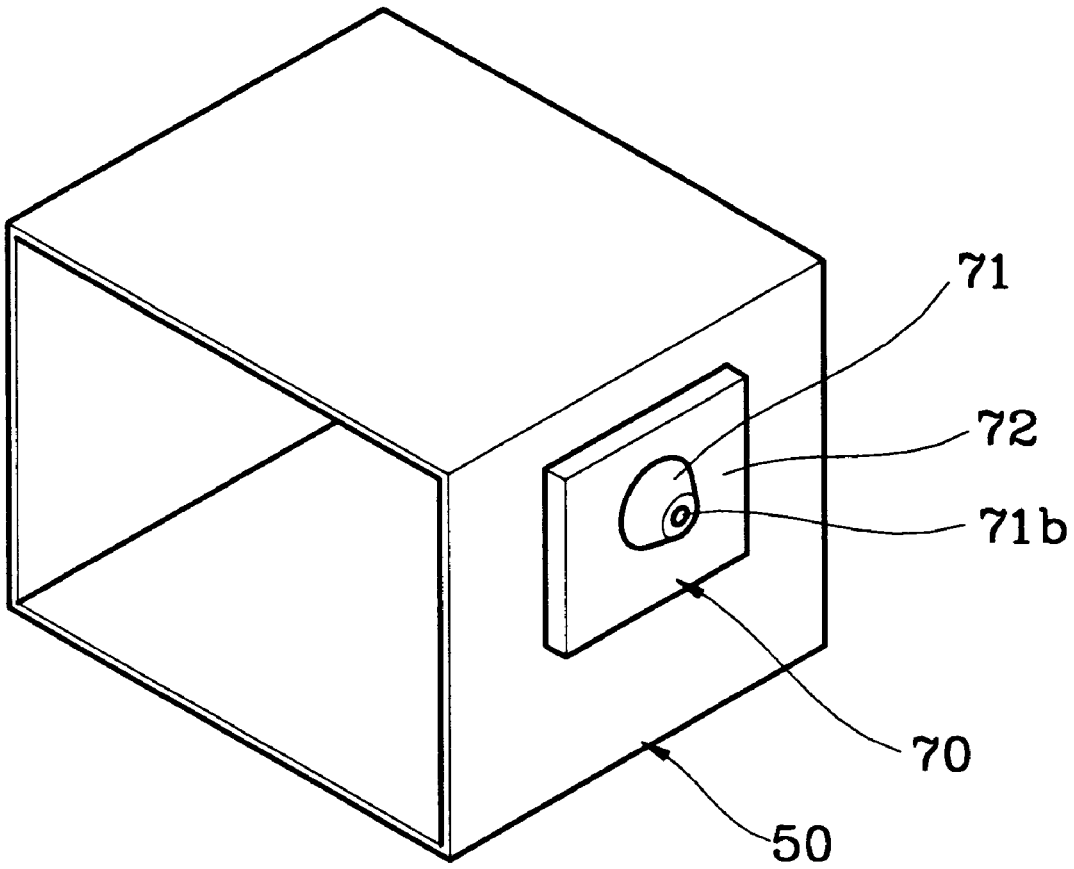
FIGS. 7 to 11 illustrate drawings according to a first embodiment of the present invention, where
Figure 8:
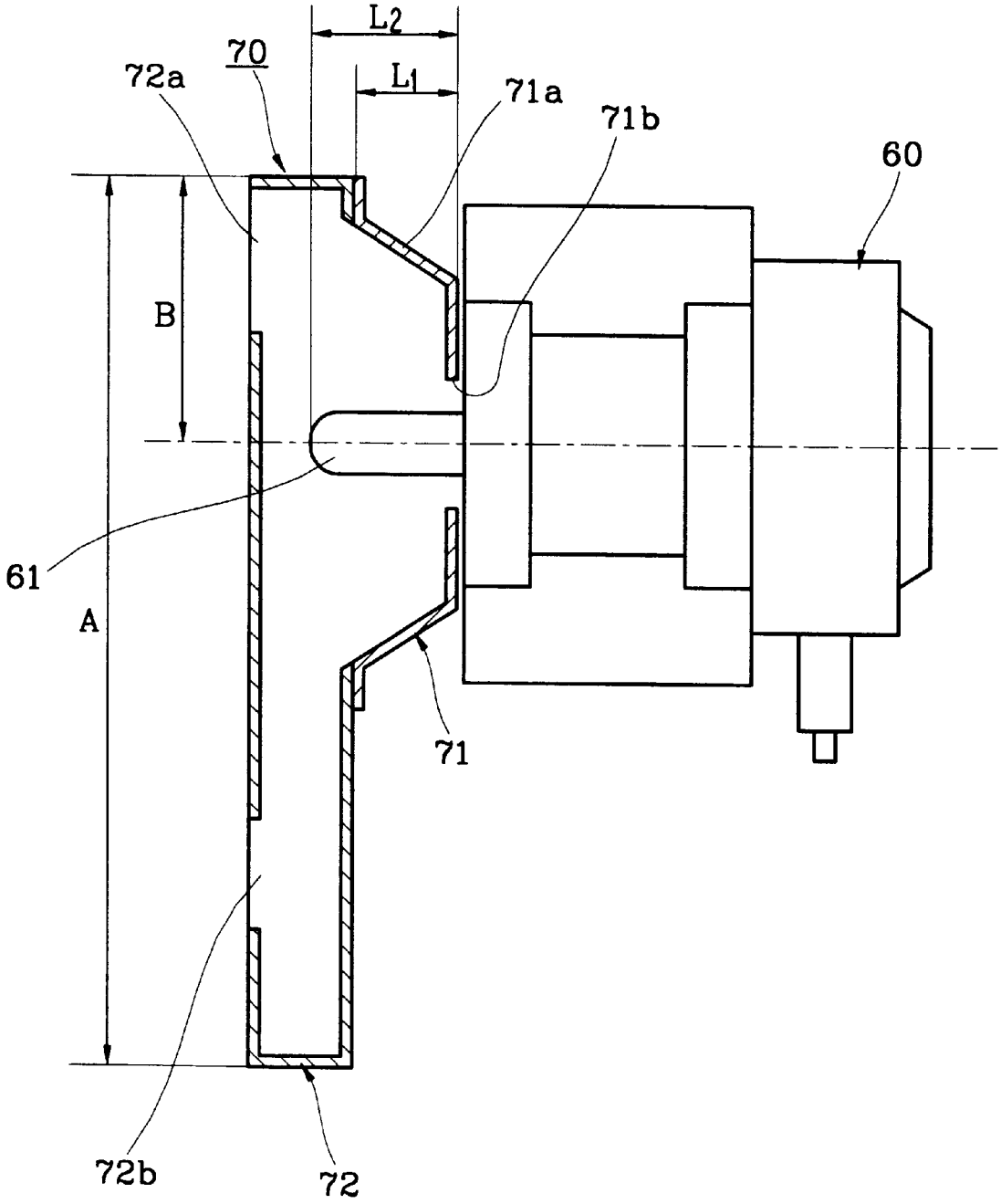

A microwave oven according to the present invention includes, as illustrated in FIGS. 7 and 8, a cavity 50 for accommodating foodstuff to be cooked, a magnetron 60 for generating microwaves having a frequency of $\lambda g$, and a waveguide 70 for guiding the microwaves generated from the magnetron 60 via an antenna 61 into the cavity 50.

At this time, the waveguide 70 consists of an input waveguide 71 and an output waveguide 72, where the input waveguide 71 is coupled to the magnetron 60 and supplies the microwaves generated from the magnetron 60 to the output waveguide 72.

Figure 9I:
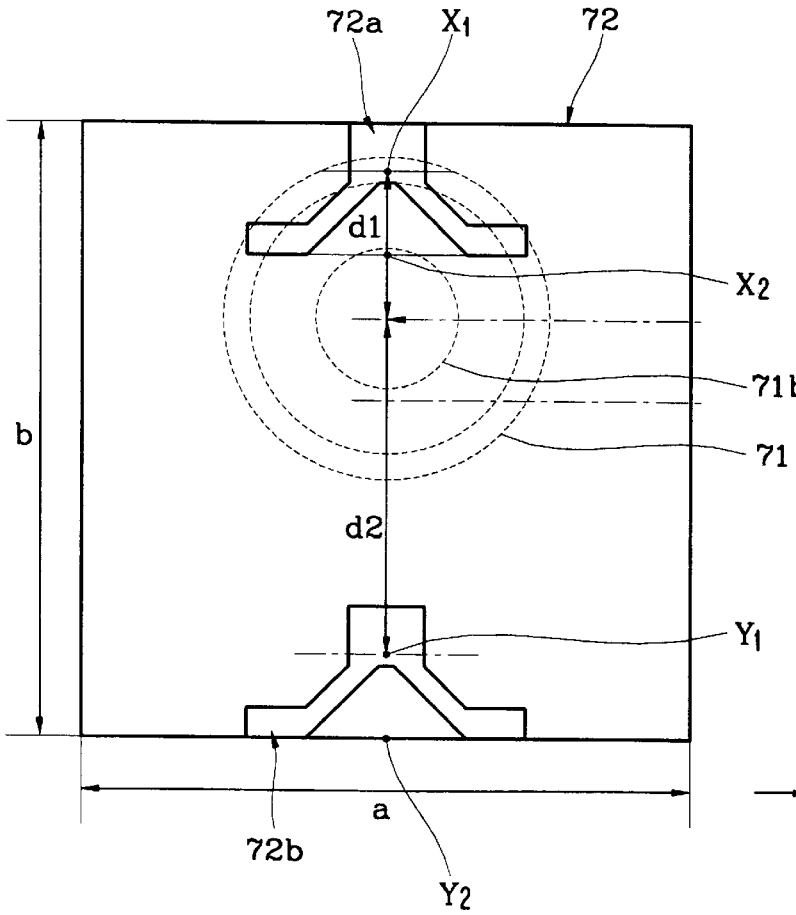
Figure 9:
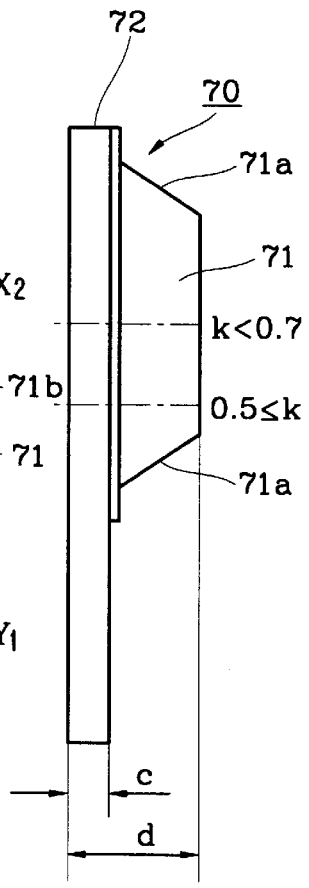

In other words, the input waveguide 71 is located, as illustrated in FIG. 9, at a little further upper rear area of the output waveguide 72 and is welded to the output waveguide 72 in a horn shape of a predetermined angle to thereby be stuck to the output waveguide 72.

The input waveguide 71 has an external slant surface 71*a* whose width L1 is a bit narrower than length of the antenna 61.

Position of the antenna 61 at the magnetron 60 in the output waveguide 72 can be obtained by Formula 5.

$$A-B=k\cdot\lambda g \quad \text{[Formula 5]}$$

Where, A=an overall length(A=a=b) of the output waveguide 72, B=a distance to the antenna 61 from a side of the output waveguide 72, K=a constant of value against a range k=0.5≦k<0.7, and λg=wavelength in the output waveguide 72.

Accordingly, the output waveguide 72 is so constructed in rectangle to have a same length in the crosswise (a) and lengthwise aspect (b), so that wavelength of one cycle of Transverse Electromagnetic Wave Mode (TE mode) and Transverse magnetic Resonant Mode (Tm mode) to the left, right, up and down in the waveguide 70 can simultaneously exist.

In other words, when a=b=λg, the wavelength in the waveguide 70 can be obtained by formulae 6 and 7.

$$\lambda g = \frac{\lambda}{\sqrt{1-\left(\frac{\lambda}{2a}\right)^2}} \quad \text{[Formula 6]}$$

$$\lambda g = \sqrt{\frac{5}{4}\lambda} \quad \text{[Formula 7]}$$

Where, a and b=breadth and length of output waveguide, λg=one wavelength in the waveguide, and in case of λ=c/f, c=speed of microwave and f=frequency of microwave.

According to Formulae 6 and 7, length of the wavelength in the waveguide 70, λg=136.4 mm (λ=c/f=122 mm), which is also the width (a) and breadth (b) of the output waveguide 72, and λg/4=34.1 mm.

At this time, height (d) of whole waveguide 70 is also λg/4, among which height (c) of the output waveguide 72 is less than 10 mm.

The output waveguide 72 is formed with an upper radiation hole 72*a* and a lower radiation hole 72*b* disposed electrically symmetrically at upper and lower central side of the cavity 50 so that the microwaves can be injected in reverse phases up/down and left/right directions.

At this time, the upper radiation hole 72*a* is upwardly disposed at a distance of d1 around a hole 71*b* formed at the input waveguide 71, and the lower radiation hole 72*b* is formed downwardly at a distance of d2 around the hole 71*b*.

Now, d1 and d2 can be obtained by formulae 8, 9 and 10.

$$d1=\lambda g/4 \quad \text{[Formula 8]}$$

$$d2=\lambda g/2 \quad \text{[Formula 9]}$$

$$d2=2\times d1 \quad \text{[Formula 10]}$$

where, d1 is formed between a slant pinnacle ($X_1$) and a radiation hole bottom line (X2) of the upper radiation hole 72*a* around the hole 71*b* when the position of the antenna (61) at the hole 71*b* is located at 0.5≦k<0.7, and d2 is positioned between a slant pinnacle ($Y_1$) and a radiation hole bottom line (Y2) of the lower radiation hole 72*b* around the hole 71*b*.

Furthermore, the upper radiation hole 72*a* and the lower radiation hole 72*b* are mutually formed in reverse V shape and symmetrically positioned around a center axis line (P).

Figure 10:
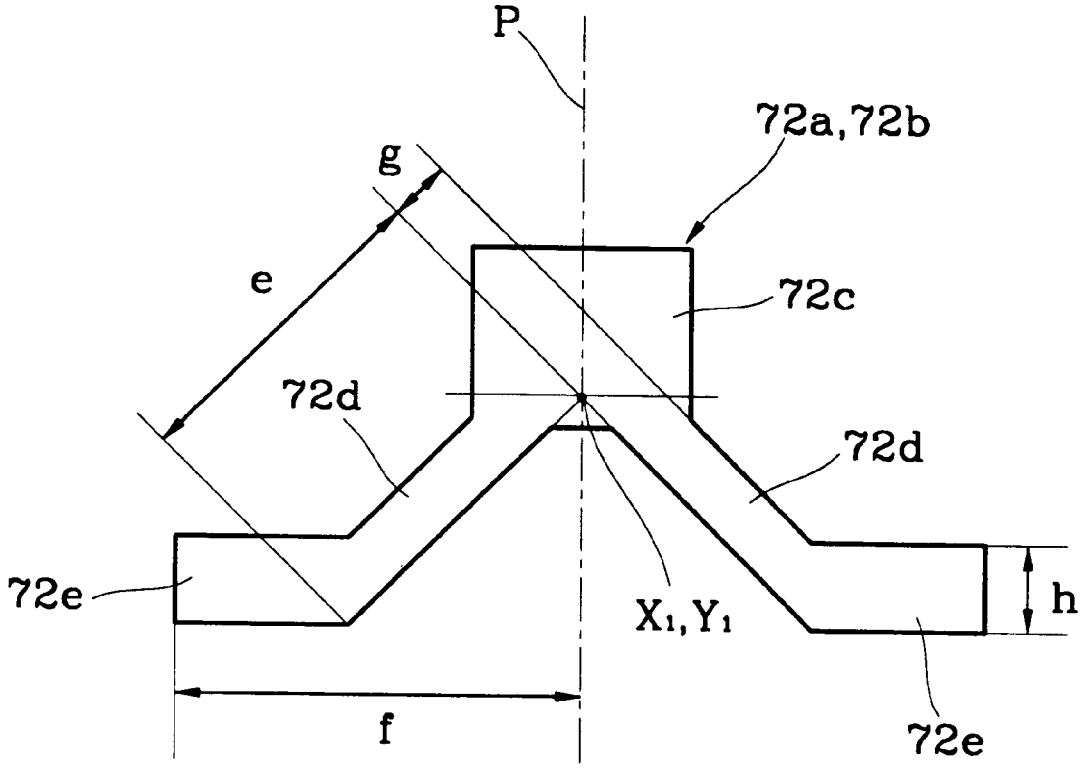

In other words, the upper radiation hole 72*a* and the lower radiation hole 72*b* are disposed, as illustrated in FIG. 10, with a vertical slot 72*c*, left/right slant slots 72*d*, respectively formed at a predetermined angle (by way of example 30–60° degrees against a horizontal line) in symmetrical shapes against a reference line of a center axis line (P) at the vertical slot 72*c* so as to communicate the vertical slot 72*c* at both lower sides thereof, and a horizontal slot 72*e* symmetrically formed at a lower external side of the left/right slant slots 72*d* so as to communicate thereto.

At this time, slanted angles of the left/right slant slot 72*d* are −45° at a left side and +45° at a right side against a horizontal line of slanted pinnacles ($X_1$, $Y_1$), and length (e) of slanted surface is λg/4, left or right length (f) thereof is respectively λg/4 and is so formed as to make λg/2 when left and right length (f) are added.

Furthermore, width (g) of the left/right slant slot 72*d* is an important element in determining an impedance and is formed at a gap less than λg/16 so as to allow the upper radiation hole 72*a* and the lower radiation hole 72*b* to have characteristics of slot radiation.

In other words, the width (g) of the left/right slant slot 72*d* should be much smaller than the wavelength (λg) in the waveguide 70 but be smaller than or equal to the width (h) of the horizontal slot 72*e*.

Next, operational effect of the first embodiment of the present invention thus constructed will be described in detail.

As illustrated in FIG. 8, when the microwaves are transmitted to the output waveguide 72 via the input waveguide 71 at the waveguide 70, some portion of the microwaves is radiated into upper side of the cavity 50 via the upper radiation hole 72*a* at the output waveguide 72 and the balance is radiated into low side of the cavity 50 via the lower output radiation hole 72*b*.

At this time, output of the microwave oven is expressed by a total sum of microwave energy radiated from the upper radiation hole 72*a* and the lower radiation hole 72*b* at the output waveguide 72.

Because the electric field energy of microwaves dispersed via the radiation holes 72*a* and 72*b* has mutually symmetrical size and phase, the size of the microwave energy is the total sum of microwaves radiated via the radiation holes 72*a* and 72*b*, and phase thereof is mutually offset to thereby generate a predetermined output.

Figure 11I:
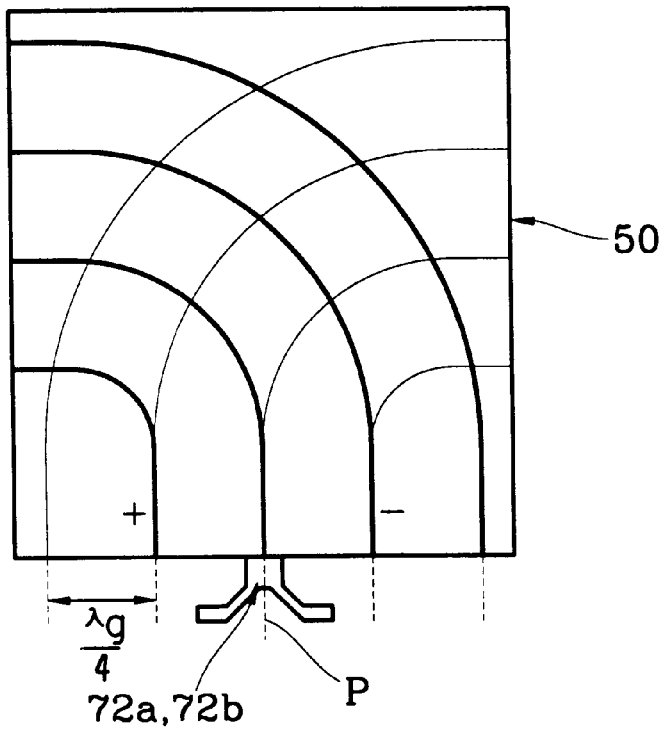

Here, as for distribution of microwaves in the cavity 50, because microwaves are reversed in phases thereof at the horizontal slot 72*c* due to difference of slanted angle of 90 degrees to thereafter be radiated into the cavity 50, cross points of microwaves having reverse phases at left and right side at a horizontal surface of the cavity 50 are generated to form various electric field modes, as illustrated in FIG. 11(I).

Figure 11:
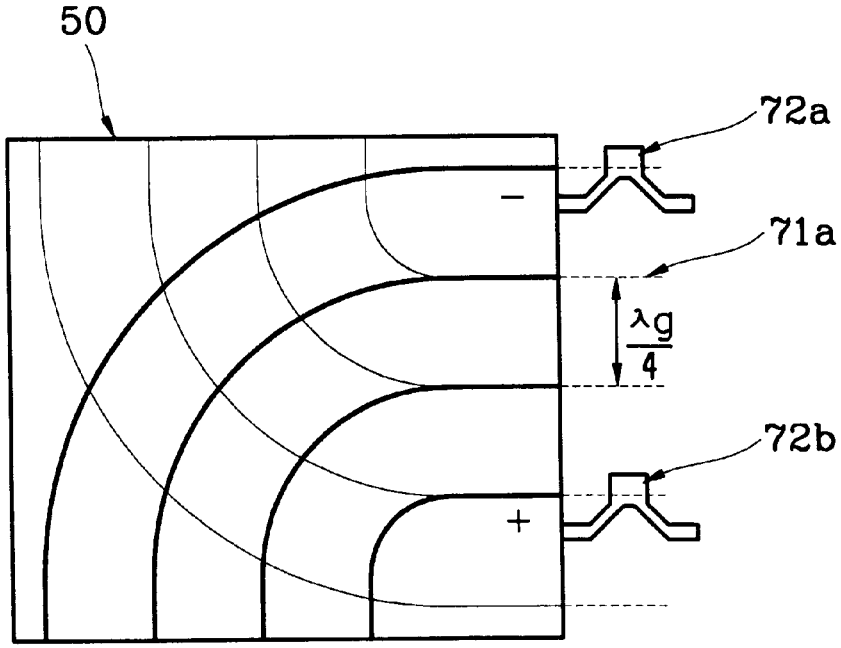

Meanwhile, because a distance difference between slanted pinnacles ($X_1$ and $Y_1$) is λg/4 (by way of example, λg/4=d2−d1, d1=λg/4, d2=λg/2) as illustrated in FIG. 11(II), microwaves having mutually reverse phases are generated to be radiated into the cavity 50 and many numbers of electromatic field distribution modes are generated on horizontal and vertical surfaces of the cavity 50.

Accordingly, the waveguide 70 according to the present invention is generated with evenly-spaced electromagnetic field distribution modes at up/down and left/right areas in the cavity 50, so much more multi electromagnetic field distribution modes are generated compared with microwave oven in conventional aperture-type waveguide or two-way type waveguide.

As described above, there is an advantage in the first embodiment of the present invention in that much more multi electromagnetic field distribution modes are formed compared with conventional two-way type of microwave oven to thereby minimize impedance changes of waveguide according to load changes of foodstuff, so that output of the microwave oven can be maintained at a constant level regardless of load weight of foodstuff and at the same time electromagnetic field distribution in the cavity can be maintained at a constant level as well.

Furthermore, there is another advantage in that a same waveguide can be easily applied to various kinds of cavities and only adjustment of slant slot width at upper and lower radiation hole can easily change cooking distribution in the cavity to thereby save lots of energy and time for development of waveguide and cavity.

Now, a second embodiment of the present invention will be described in detail with reference to FIGS. 12 and 13.

Like reference numerals and symbols as in the first embodiment for the same construction are used for designation of like or equivalent parts or portions and redundant references will be omitted for simplicity of illustration and explanation.

According to the second embodiment of the present invention, an upper radiation hole 72*a* and a lower radiation hole 72*b* are respectively formed at upper and lower side of lateral center area in the cavity in an electrically symmetry, so that microwaves of reverse phase at up/down and left/right directions can be injected, and a left and right radiation hole 73 and 74 are respectively formed at left and right side of central lateral side of the cavity 50 in an electrical symmetry between the upper and lower radiation hole 72*a* and 72*b*.

At this time, the left radiation hole 73 is provided with a horizontal slot 73*a* formed toward upper left direction, a slant slot 73*b* extensively formed at a predetermined angle (by way of example, 30–60 degrees against horizontal line) downwardly from a right end of the horizontal slot 73*a* and a vertical slot 73*c* vertically extended from a bottom end of the slant slot 73*b*.

The right radiation hole 74 is disposed with a vertical slot 74*a* vertically formed at an upper end thereof, a slant slot 74*b* extensively formed at a predetermined angle(by way of example, 30–60 degrees against horizontal line) from a bottom end of the vertical slot 74*a* and a horizontal slot 74*c* extensively formed toward right direction from a bottom end of the slant slot 74*b*.

Figure 13I:
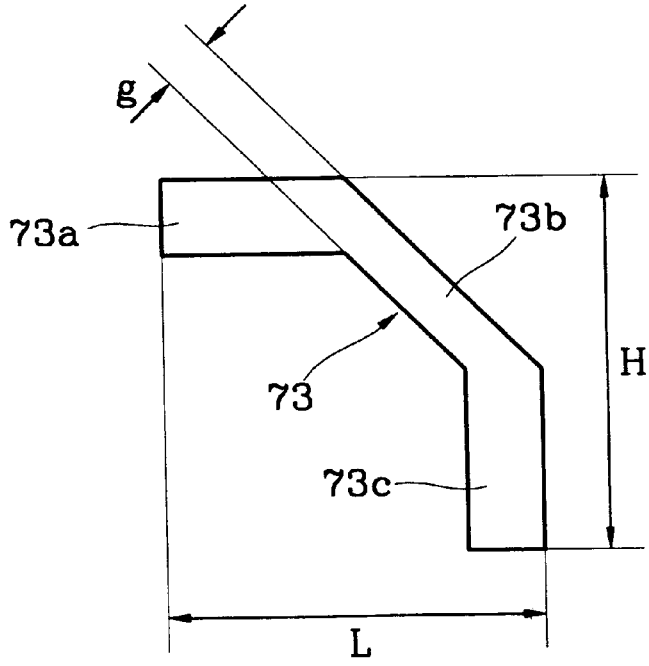
Figure 13:
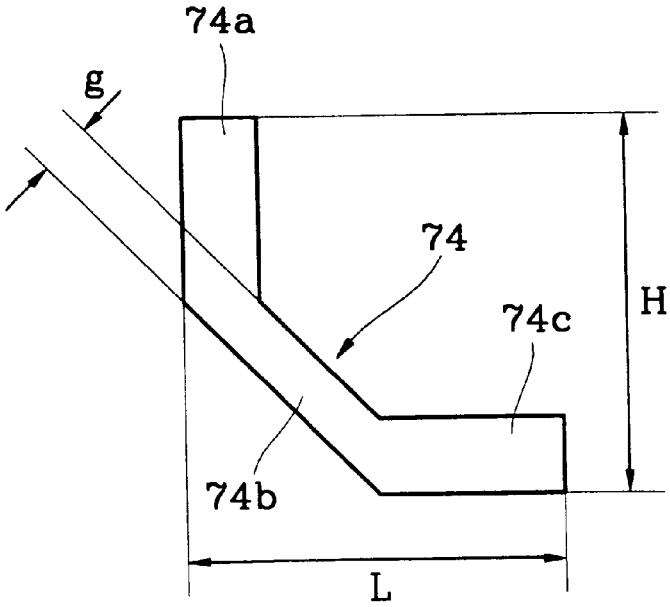

The slant slots 73*b* and 74*b* are respectively formed at an angle +45 degrees against horizontal line, as illustrated in FIG. 13, and width (g) thereof is much narrower than wavelength (λg) in the waveguide 70 but equal to or narrower than width (h) of the horizontal slots 73*a* and 74*c* and vertical slots 73*c* and 74*a*.

In other words, the slant slots 73*b* and 74*b* formed at the left/right radiation holes 73 and 74 are formed at the same slant angle and width (g) as the slant slot 72*d* formed at the upper and lower radiation holes 72*a* and 72*b*.

Furthermore, the left/right radiation holes 73 and 74 are respectively arranged at left and right side of the output waveguide 72 so as to be positioned at a grid region generated at even interval of λg/4 lengthwise (b) and crosswise (a) of the output waveguide 72.

Next, operational effect of the second embodiment of the present invention thus constructed will be described in detail.

When the microwaves generated by oscillation of the magnetron 60 are transmitted to the output waveguide 72 through the input waveguide 71 at the waveguide 70, some portions of the microwaves are dispersed into an upper inner side of the cavity 50 via the upper radiation hole 72*a* at the output waveguide 72 and balance is injected into a lower inner side of the cavity 50 through the lower radiation hole 72*b* at the output waveguide 72.

Furthermore, some portions of the microwaves are injected into a left inner side of the cavity 50 through the left radiation hole 73 at the output waveguide 72 and balance is injected into a right inner side of the cavity 50 through the right radiation hole 74 at the output waveguide 72.

At this time, output of the microwave oven is represented by a sum of microwave energy injected from the upper and lower radiation hole 72*a* and 72*b* and the left and right radiation hole 73 and 74. Because electromagnetic field energy of the microwaves radiated through the upper, lower, left and right radiation hole, 72*a*, 72*b*, 73 and 74 have mutually symmetrical phases and sizes, magnitude of microwave energy is the sum of the microwaves radiated through the upper and lower radiation hole 72*a* and 72*b* and left and right radiation hole 73 and 74, and phases are mutually offset to generate a predetermined output.

Figure 12I:
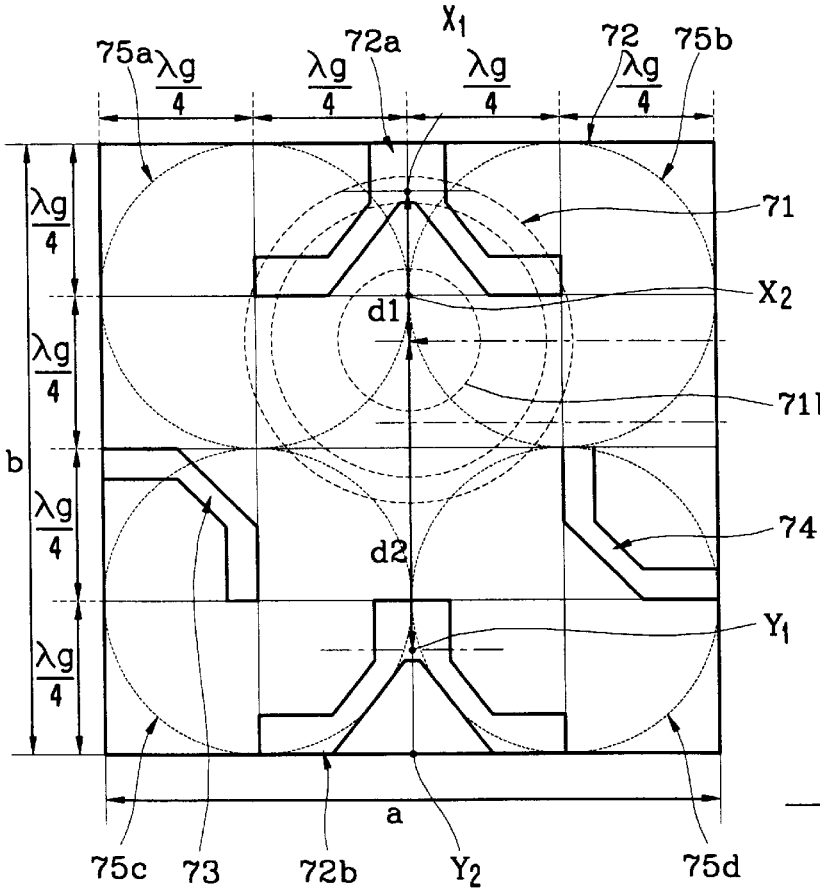
FIGS. 12 and 13 are drawings according to a second embodiment of the present invention, where FIGS. 12(I) and 12(II) are front and side views for illustrating an assembled state between an input waveguide and an output waveguide of a waveguide according to the present invention.
Figure 12:
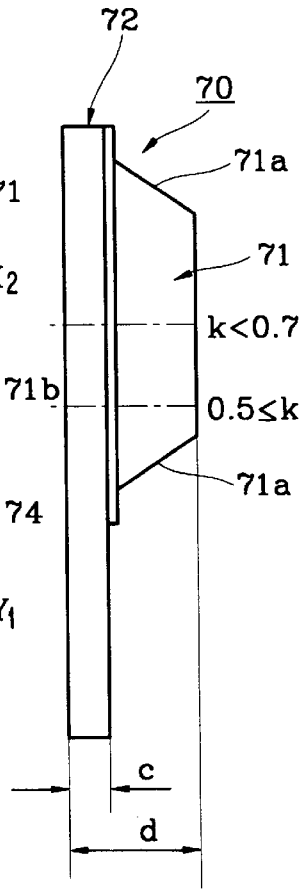

In other words, as illustrated in FIG. 12, crosswise (a) and lengthwise (b) length at the output waveguide 72 is the same as the wavelength (λg) in the waveguide 70, so that electromagnetic field modes are numbered 4, and, when the output waveguide 72 is vertically and horizontally divided by λg/4 interval, 16 grid shapes are generated.

At this time, the upper radiation hole 72*a* is situated at two grids of upper central position and the lower radiation hole 72*b* is positioned at other 2 grids of lower central area. The left radiation hole 73 is located at a second left tip end therefrom and the right radiation hole 74 is provided at a second right tip end therefrom.

Meanwhile, let's see operational characteristics of the upper and lower radiation hole 72*a* and 72*b* and the left and right radiation hole 73 and 74. The upper radiation hole 72*a* and the lower radiation hole 72*b* are formed in the same shape and situated symmetrically around a central axis line (P), and slot length (L) thereof is λg/2, height(h) thereof is λg/4 and slot width (g) thereof is $g \leqq \lambda g$.

Furthermore, slant slots 72*d*, 73*d* and 74*b* of slot at the upper and lower radiation hole 72*a* and 72*b* and left and right radiation hole 73 and 74 are vertically or horizontally positioned against a central point of the electromagnetic field distribution (75*a*, 75*b*, 75*c* and 75*d*) in the output waveguide 72.

In other words, magnetic field is output when slant direction of slot at the upper radiation hole 72*a* is vertically positioned against the central point of the electromagnetic field distribution (75*a*, 75*b*), and magnetic field is output when the slant direction of the slot at the lower radiation hole 72*b* is horizontally situated against the central point of the electromagnetic field distribution (75*c*, 75*d*).

As mentioned above, the electromagnetic field and magnetic field are 90 degrees in phase characteristics thereof, so that impedance characteristic (phase) of slot is different by 90 degrees to thereby compensate and offset the change of the impedance.

Furthermore, slot length (L) and slot height (H) of left and right radiation hole 73 and 74 are respectively λg/4 and slot width thereof is $g \leqq \lambda g$.

At this time, the left radiation hole 73 is vertical at slot slant direction thereof against a central point of the electromagnetic field distribution (75*c* and 75*d*) to thereby cause the magnetic field to be generated and the right radiation hole 74 is horizontal at slot slant direction thereof against a central point of the electromagnetic field distribution (75*c* and 75*d*) to thereby cause the magnetic field to be generated.

Accordingly, evenly spaced electromagnetic field distribution modes are generated at left/right and upper/lower directions inside the cavity 50 according to the waveguide 70 of the present, so that much more multi electromagnetic field distribution modes are formed compared with conventional aperture method of waveguide or two-way method of waveguide.

Furthermore, slot array antenna provided with upper/lower radiation hole (72*a*, 72*b*) and left/right radiation hole (73, 74) at the output waveguide 72 can increase more gains and directional characteristics than those of single slot radiation to thereby improve an output performance and cooking efficiency of a microwave oven.

As apparent from the second embodiment of the present invention, there is an advantage in that, construction is designed such that microwaves generated by oscillation of magnetron are transmitted into an input waveguide of a rectangular waveguide and, at the same time, are radiated into an inner area of a cavity through upper/lower and left/right radiation holes, so that microwaves radiated by the upper/lower and left/right radiation holes are injected with phases reversed in upper/lower and left/right directions, thereby forming much more electromagnetic field distribution modes than those of the conventional two-way method of microwave oven, and minimizing impedance change of waveguide according to load changes of foodstuff to thereby maintain output of the microwave at a constant level regardless of the load quantity and to keep the electromagnetic field distribution in the cavity at a predetermined level as well.

What is claimed is:

1. A microwave oven having an input waveguide and an output waveguide, the output waveguide including an upper radiation hole and a lower radiation hole, the upper and lower radiation holes comprising:

a vertical slot;

left and right inclined slot, each slot formed in a reverse V-shape so as to be horizontally symmetrical around a central axis line (P) of the vertical slot and in cooperation with the vertical slot at both lower ends thereof, and formed in horizontally slanted at 30°–60°; and horizontal slots, each slot formed at horizontally symmetrical to be cooperative with the left and right inclined slot at a lower external side of the left and right inclined slot.

2. The microwave oven as defined in claim 1, wherein the left and right inclined slot are respectively formed at −45° at left side and at +45° at right side around a horizontal line of slanted pinnacle ($X_1$, $Y_1$).

3. The microwave oven as defined in claim 1, wherein a slanted surface length (e) at the left and right slant slot is λg/4.

4. The microwave oven as defined in claim 1, wherein a left/right length (f) at the left and right slant slot is λg/4 on a base of a central axis line (P) and sum of left and right slant slot is formed to be λg/2.

5. The microwave oven as defined in claim 1, wherein width (g) of the left and right slant slot is formed in less than λg/16.

6. The microwave oven as defined in claim 1, wherein width (g) of the left and right slant slot is much narrower than wavelength (λg) in the waveguide and narrower than or equal to height (h) of the horizontal slot.

7. A microwave oven having an input waveguide and an output waveguide including an upper radiation hole and a lower radiation hole, wherein the output waveguide has a width (a) and a length (b) obtainable by a formula of a=b=λg, so that microwaves generated by oscillation of the magnetron can be distributed in wavelength (λg) of one cycle in left/right and up/down directions.

8. A microwave oven having an input waveguide and an output waveguide including an upper radiation hole and a lower radiation hole, wherein the output waveguide is respectively formed at central left/right sides at cavity lateral surface with a left radiation hole and a right radiation hole each having a slot width (g) of g≦λg, so as to radiate microwaves of reverse phases into the cavity.

9. The microwave oven as defined in claim 8, wherein the left radiation hole comprises:

a horizontal slot formed to an upper left direction thereof;

a slant slot extensively and downwardly formed at a predetermined slanted angle from a right end of the horizontal slot; and a vertical slot vertically extensively formed from a bottom end of the slant slot.

10. The microwave oven as defined in claim 8, wherein the right radiation hole comprises:

a vertical slot vertically formed at an upper end thereof;

a slant slot extensively formed at a predetermined slant angle from a bottom end of the vertical slot; and a horizontal slot extensively formed to the right direction from a bottom end of the slant slot.

11. The microwave oven as defined in claim 8, wherein the left and the right radiation hole are respectively formed at left and right side of the output waveguide so as to be positioned at a grid domain evenly partitioned at a λg/4 interval toward breadthwise (a) and lengthwise (b) from the output waveguide.

12. The microwave oven as defined in claim 9 or 10, wherein the slant angle of the slant slot is formed at +45° on a base of a horizontal line.

13. A microwave oven having an input waveguide, and an output waveguide, the microwave oven comprising:

a magnetron in the output waveguide, the position (A–B) of an antenna of the magnetron being obtained by a formula reading as A–B=k·λg. where, A=overall length of the output waveguide, B=a distance to the antenna of the magnetron at one side of the output waveguide, k is a constant defined as 0.5≦k<0.7 and λg=wavelength in the output waveguide, a first distance between the center of a first hole formed at the input waveguide and an upper radiation hole being λg/4, a second distance between the center of the first hole and a lower radiation hole being λg/2, an upper end of the first distance varying between a slant pinnacle of the upper radiation hole and a bottom line of the upper radiation hole when a position of the antenna at the first hole changes in the range of 0.5≦k<0.7.

14. A microwave oven having an input waveguide, and an output waveguide, the microwave oven comprising:

a magnetron in the output waveguide, the position (A–B) of an antenna of the magnetron being obtained by a formula reading as A·B=k·λg, where, A=overall length of the output waveguide, B=a distance to the antenna of the magnetron at one side of the output waveguide, k is a constant defined as 0.5≦k≦0.7, and λg=wavelength in the output waveguide, a first distance between the center of a first hole formed at the input waveguide and an upper radiation hole being λg/4, a second distance between the center of the first hole and a lower radiation hole being λg/2, a lower end of the second distance varying between a slant pinnacle of the lower radiation hole and a bottom line of the lower radiation hole when a position of the antenna at the first hole changes in the range of 0.5≦k<0.7.

* * * * *